US006089332A

United States Patent [19]

Barr et al.

[11] Patent Number: 6,089,332

[45] **Date of Patent: *Jul. 18, 2000**

[54] STEERABLE ROTARY DRILLING SYSTEMS

[75] Inventors: John D. Barr, Cheltenham; John M. Clegg, Bristol; William C. Motion, Cheltenham, all of United Kingdom

[73] Assignee: Camco International (UK) Limited, Gloucestershire, United Kingdom

[ * ] Notice: This patent is subject to a terminal disclaimer.

[21] Appl. No.: 09/004,592

[22] Filed: Jan. 8, 1998

Related U.S. Application Data

[63] Continuation of application No. 08/604,318, Feb. 21, 1996, Pat. No. 5,803,185.

[30] Foreign Application Priority Data

Feb. 25, 1995 [GB] United Kingdom ..... 9503827

[51] Int. Cl.[7] ..... E21B 7/08; E21B 47/024

[52] U.S. Cl. ..... 175/45; 175/61; 175/73

[58] Field of Search ..... 175/40, 45, 61, 175/73, 76

[56] References Cited

FOREIGN PATENT DOCUMENTS 2257182 1/1993 United Kingdom .

2259316 3/1993 United Kingdom .

*Primary Examiner*—Frank Tsay
*Attorney, Agent, or Firm*—Brigitte Jeffery

[57] ABSTRACT

A steerable rotary drilling system has a bottom hole assembly which includes, in addition to the drill bit, a modulated bias unit and a control unit, the bias unit comprising a number of hydraulic actuators around the periphery of the unit, each having a movable thrust member which is hydraulically displaceable outwardly for engagement with the formation of the borehole being drilled. Each actuator may be connected, through a control valve, to a source of drilling fluid under pressure and the operation of the valve is controlled by the control unit so as to modulate the fluid pressure supplied to the actuators as the bias unit rotates. If the control valve is operated in synchronism with rotation of the bias unit the thrust members impart a lateral bias to the bias unit, and hence to the drill bit, to control the direction of drilling. Pulses transmitted through the drilling fluid as a result of operation of the bias unit are detected and interpreted at the surface, or at a different location downhole, to obtain information regarding the operation of the bias unit or other parts of the bottom hole assembly. Data signals from downhole sensors may be arranged to modify the control and operation of the bias unit in such manner that the data is encoded as pulses generated in the drilling fluid by the bias unit.

16 Claims, 5 Drawing Sheets

STEERABLE ROTARY DRILLING SYSTEMS

This Application is a Continuation Application of U.S. patent application Ser. No. 08/604,318, filed Feb. 21, 1996, now U.S. Pat. No. 5,803,185.

BACKGROUND OF THE INVENTION

1. Field of the Invention

The invention relates to steerable rotary drilling systems and provides, in particular, methods and apparatus for the transmission of data from the bottom hole assembly of such a drilling system, either to the surface or to another downhole location.

2. Setting on the Invention

When drilling or coring holes in subsurface formations, it is sometimes desirable to be able to vary and control the direction of drilling, for example to direct the borehole towards a desired target, or to control the direction horizontally within the payzone once the target has been reached. It may also be desirable to correct for deviations from the desired direction when drilling a straight hole, or to control the direction of the hole to avoid obstacles.

Rotary drilling is defined as a system in which a bottom hole assembly, including the drill bit, is connected to a drill string which is rotatably driven from the drilling platform at the surface. Hitherto, fully controllable directional drilling has normally required the drill bit to be rotated by a downhole motor. The drill bit may then, for example, be coupled to the motor by a double tilt unit whereby the central axis of the drill bit is inclined to the axis of the motor. During normal drilling the effect of this inclination is nullified by continual rotation of the drill string, and hence the motor casing, as the bit is rotated by the motor. When variation of the direction of drilling is required, the rotation of the drill bit is stopped with the bit tilted in the required direction. Continued rotation of the drill bit by the motor then causes the bit to drill in that direction.

Although such arrangements can, under favorable conditions, allow accurately controlled directional drilling to be achieved using a downhole motor to drive the drill bit, there are reasons why rotary drilling is to be preferred, particularly in long reach drilling.

Accordingly, some attention has been given to arrangements for achieving a fully steerable rotary drilling system.

The present invention relates to a steerable rotary drilling system of the kind where the bottom hole assembly includes, in addition to the drill bit, a modulated bias unit and a control unit, the bias unit comprising a number of hydraulic actuators at the periphery of the unit, each having a movable thrust member which is hydraulically displaceable outwardly for engagement with the formation of the borehole being drilled, each actuator having an inlet passage for connection, through a control valve, to a source of drilling fluid under pressure, the operation of the valve being controlled by the control unit so as to modulate the fluid pressure supplied to the actuators as the bias unit rotates.

Although there are preferably provided a plurality of actuators spaced apart around the periphery of the bias unit, the invention also relates to systems where the bias unit has only a single actuator.

In one mode of operation, when steering is taking place, the control unit causes the control valve to operate in synchronism with rotation of the bias unit, and in selected phase relation thereto whereby, as the bit rotates, the or each movable thrust member is displaced outwardly at the same selected rotational position so as to bias laterally the bias unit and the drill bit connected to it, and thereby control the direction of drilling.

A steerable rotary drilling system of this kind is described and claimed, for example, in British Patent Specification No. 2259316. One form of control unit for use in such a system is described and claimed in British Patent Specification No. 2257182.

In the course of operating a steerable rotary drilling system it may be necessary to transmit to the surface data giving information on the operating parameters of the bottom hole assembly. For example, it may be required to transmit information concerning the status of the equipment including the control unit and bias unit, or information concerning the command status, that is to say the instructions which the control unit is giving to the bias unit. Furthermore, it may be required to transmit to the surface survey information regarding the azimuth and inclination of part of the bottom hole assembly, or the roll angle of the control unit, or geological information.

Such information may in some cases be transmitted to another downhole location, either for onward transmission to the surface by other means, or to control operation of another piece of downhole equipment.

There are various well known methods currently employed for transmitting data from a bottom hole assembly to the surface, since such requirement also exists for directional drilling using a downhole motor as well as for measurement-while-drilling (MWD) systems generally. One method commonly used is to transmit data to the surface as a sequence of pulses transmitted upwardly through the drilling fluid by a specially designed pulser which is included in the bottom hole assembly and responds to data signals from appropriate sensors in the assembly. In a common form of pulser, known as a negative pulser, a negative pulse (i.e. a pulse causing a drop in fluid pressure) is generated by the temporary diversion to the annulus of a proportion of the drilling fluid passing downwardly through the drill string to the drill bit. However, there are difficulties in using such a pulser in a steerable rotary drilling system of the kind first referred to. For example, a negative pulser requires the provision of mechanical hardware mounted on the drill collar to effect the diversion of fluid through a passage in the drill collar leading to the annulus. Such hardware also requires a power source for its operation, which must also be mounted on the drill collar.

In the preferred embodiment of the system to which the present invention relates, however, the control unit is a roll stabilized instrument carrier which is rotatable relative to the drill collar. This makes it difficult to pass power and control instructions from the control unit to a relatively rotating pulser hardware on the drill collar. It is possible to mount on the control unit a positive pulser of the kind where pulses are generated by choking or cutting off part of the flow of drilling fluid along the drill string but, again, there are practical difficulties in this.

The present invention is based on the real sation that the bias unit itself has certain of the characteristics of a negative pulser, in that during its operation it diverts to the annulus a varying proportion of the drilling fluid which would otherwise pass to the drill bit. The invention therefore lies, in its broadest aspect, in using the bias unit itself as a pulser for transmitting data pulses to the surface or to another downhole location.

The term "pressure pulse" will be used to refer to any detectable change in pressure caused in the drilling fluid, regardless of the duration of the change, and is not necessarily limited to temporary changes in pressure of short duration.

SUMMARY OF THE INVENTION

According to the invention there is provided a method of operating a steerable rotary drilling system of the kind where the bottom hole assembly includes, in addition to the drill bit, a modulated bias unit and a control unit, the bias unit comprising a number of hydraulic actuators at the periphery of the unit, each having a movable thrust member which is hydraulically displaceable outwardly for engagement with the formation of the borehole being drilled, each actuator having an inlet passage for connection, through a control valve, to a source of drilling fluid under pressure, the operation of the valve being controlled by the control unit so as to modulate the fluid pressure supplied to the actuators as the bias unit rotates, the method including the step of deriving data signals in the bottom hole assembly, causing the control unit to control the bias unit in a manner dependent on said data signals, detecting pulses transmitted through the drilling fluid as a result of the consequent operation of the bias unit, and interpreting said pulses to derive therefrom data corresponding to said data signals from the bottom hole assembly.

The pulses which are detected and interpreted may generated by the operation of an additional shut-off valve in series with said control valve. For example, the data signals may be encoded as a sequential pattern of successive operations of said shut-off valve. In the case where the control unit comprises an instrument carrier which can be roll stabilized so as to remain substantially non-rotating in space, the direction of bias of the bias unit being determined by the rotational orientation of the instrument carrier, said shut-off valve may be operated by reversal of the direction of relative rotation between the instrument carrier and the drill string, said data signals being encoded as a sequential pattern of successive reversals of said relative rotation.

In other cases where the control unit comprises an instrument carrier which can be roll stabilized so as to remain substantially non-rotating in space, the direction of bias of the bias unit being determined by the rotational orientation of the instrument carrier, the data signals may be encoded as some other rotation, or sequential pattern of rotations, of the instrument carrier relative to the drill string.

Said rotation or sequential pattern of rotations of the instrument carrier may be in either direction, at any achievable speed, and of any practical duration. It will therefore be appreciated that this allows a number of permutations and combinations of these variables, to permit the encoding of a considerable quantity and/or variety of data if required.

Where a roll stabilizable instrument carrier is provided the instrument carrier may include a sensor to determine the angular position of the carrier relative to the drill collar in which it is rotatably mounted, and/or its rate of change, the output of the sensor then being used as an input parameter in the control of the rotation of the carrier.

The necessary rotational control of the instrument carrier may be effected by the provision of two contra-rotating controllable torque impellers on the carrier, as described in our co-pending application No. 9503828.7.

Said data signals may be derived from sensors in the bottom hole assembly. Such sensors may be of a kind to provide data signals concerning the azimuth or inclination of part of the bottom hole assembly, or the roll angle of the control unit. For example, such sensors might be inclinometers and/or magnetometers which supply calibrated survey data. The sensors might also be geological sensors responsive to characteristics of the formation through which the bottom hole assembly is passing. Such sensors may be of any of the kinds commonly used for formation evaluation, such as gamma ray detectors, neutron detectors or resistivity sensors. Hitherto it has been necessary to provide such sensors in a separate formation evaluation and transmission package located some distance from the drill bit. In that case, however, the signals transmitted from the package represent the characteristics of the formation through which the drill bit has already passed and this is not necessarily the same as the formation through which the drill bit is actually passing at the time the signals are sent to the surface. Since, according to the present invention, the data transmission means is an integral part of the bottom hole assembly, adjacent the drill bit, the geological sensors may also be located much closer to the drill bit and the transmitted signals therefore give a more accurate picture of the formation through which the bit is actually passing. This enables the drill bit to be controlled more accurately in response to the geological information.

The aforesaid data signals may also be derived from sensors responsive to vibration or shock to which the bottom hole assembly is subjected, as well as to weight-on-bit, torque, temperature or the occurrence of stick/slip motion.

Alternatively or additionally, the data signals which are transmitted by the bias unit in accordance with the present invention may be signals originated downhole in response to an operation of the control unit or in response to a downward telemetry signal transmitted from the surface, to confirm that such signal has been correctly received.

Since interruption of the rotation of the drill string may increase the risk of the drill string becoming stuck in the borehole, it is preferable for rotation to be maintained while the data pulses are transmitted. However, the drill bit is preferably lifted off the bottom of the borehole while transmission is taking place, to reduce torsional oscillations of the bottom hole assembly, and so that any spurious operations of the bias unit resulting from the signal-transmitting rotations of the control unit are not converted into unwanted deviations of the borehole. Alternatively, the biasing effect of the bias unit may be reduced while transmission is taking place.

The method also provides a method of operating a steerable rotary drilling system of the kind where the bottom hole assembly includes, in addition to the drill bit, a modulated bias unit and a control unit, the bias unit comprising a number of hydraulic actuators at the periphery of the unit, each having a movable thrust member which is hydraulically displaceable outwardly for engagement with the formation of the borehole being drilled, each actuator having an inlet passage for connection, through a control valve, to a source of drilling fluid under pressure, the operation of the valve being controlled by the control unit so as to modulate the fluid pressure supplied to the actuators as the bias unit rotates, the method comprising the steps of detecting pulses transmitted through the drilling fluid as a result of operation of the bias unit, and interpreting said pulses to obtain information regarding the operation of the bottom hole assembly including the bias unit.

The pulses which are detected and interpreted may be generated by the operation of the control valve controlling the hydraulic actuators. The pulses may be detected and interpreted at the surface, the information derived therefrom then being used as an input parameter for the control of the bottom hole assembly. Alternatively, the pulses may be detected and interpreted at a downhole location, the information derived therefrom then being used as an input parameter for a further data transmission device.

When the bias unit is operating, the pulses which the bias unit transmits through the drilling fluid as a result of such operation may be detected and interpreted to ensure that the bias unit is operating correctly. For example, when first being introduced into an existing borehole, the bias unit may be temporarily held just below the surface and various tests of its operation carried out, the characteristic pulses resulting from such test indicating whether or not everything is in order.

The invention also provides a steerable rotary drilling system of the kind where the bottom hole assembly includes, in addition to the drill bit, a modulated bias unit and a control unit, the bias unit comprising a number of hydraulic actuators at the periphery of the unit, each having a movable thrust member which is hydraulically displaceable outwardly for engagement with the formation of the borehole being drilled, each actuator having an inlet passage for connection, through a control valve, to a source of drilling fluid under pressure, the operation of the valve being controlled by the control unit so as to modulate the fluid pressure supplied to the actuators as the bias unit rotates, and including means to detect and interpret pulses transmitted through the drilling fluid as a result of operation of the bias unit.

The drilling system may further include downhole sensors to detect operating parameters of the system and generate data signals corresponding to said parameters, and means downhole for receiving said data signals and causing the control unit to control the bias unit in a manner dependent on said data signals to transmit said pulses through the drilling fluid to said detection means.

DETAILED DESCRIPTION OF THE PREFERRED EMBODIMENTS

In the following description the terms "clockwise" and "anti-clockwise" refer to the direction of rotation as viewed looking downhole.

Figure 1:
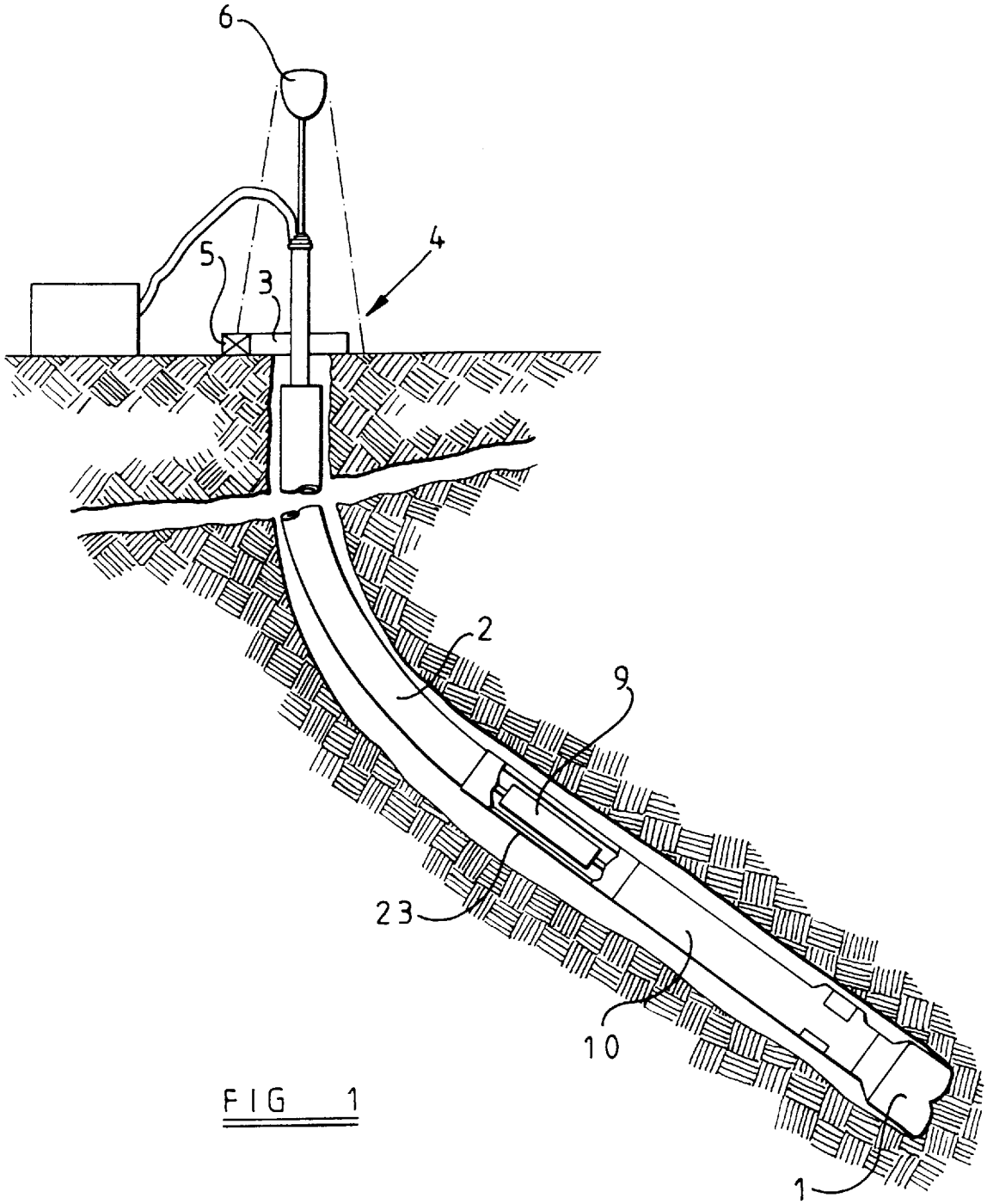
FIG. 1 is a diagrammatic sectional representation of a deep hole drilling installation.

FIG. 1 shows diagrammatically a typical rotary drilling installation of a kind in which the present invention may be employed.

As is well known, the bottom hole assembly includes a drill bit 1, and is connected to the lower end of a drill string 2 which is rotatably driven from the surface by a rotary table 3 on a drilling platform 4. The rotary table is driven by a drive motor indicated diagrammatically at 5 and raising and lowering of the drill string, and application of weight-on-bit, is under the control of draw works indicated diagrammatically at 6.

The bottom hole assembly includes a modulated bias unit 10 to which the drill bit 1 is connected and a roll stabilized control unit 9 which controls operation of the bias unit 10 in accordance with an on-board computer program, and/or in accordance with signals transmitted to the control unit from the surface. The bias unit 10 can be controlled to apply a lateral bias to the drill bit I in a desired direction so as to control the direction of drilling.

Figure 2:
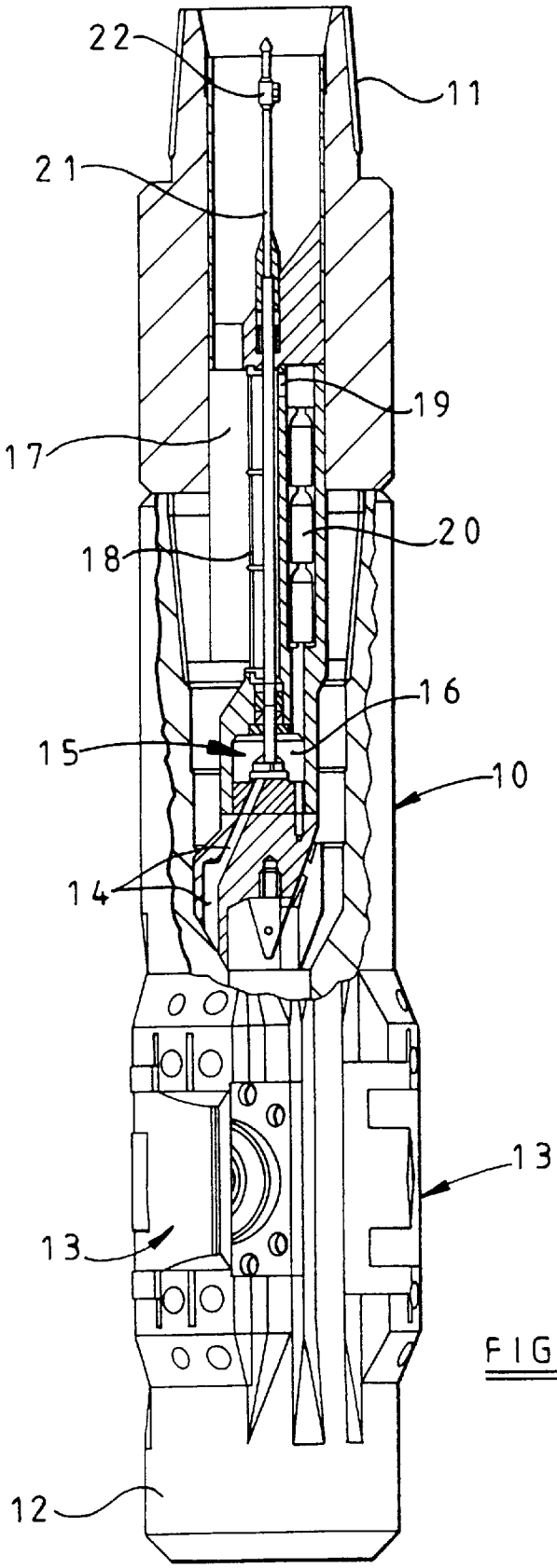
FIG. 2 is a part-longitudinal section, part side elevation of a modulated bias unit of the kind to which the present invention may be applied.

Referring to FIG. 2, the bias unit 10 comprises an elongate main body structure provided at its upper end with a threaded pin 11 for connecting the unit to a drill collar, incorporating the roll stabilized control unit 9, which is in turn connected to the lower end of the drill string. The lower end 12 of the body structure is formed with a socket to receive the threaded pin of the drill bit. The drill bit may be of any type.

There are provided around the periphery of the bias unit, towards its lower end, three equally spaced hydraulic actuators 13. Each hydraulic actuator 13 is supplied with drilling fluid under pressure through a respective passage 14 under the control of a rotatable disc control valve 15 located in a cavity 16 in the body structure of the bias unit. Drilling fluid delivered under pressure downwardly through the interior of the drill string, in the normal manner, passes into a central passage 17 in the upper part of the bias unit, through a filter 18 consisting of closely spaced longitudinal wires, and through an inlet 19 into the upper end of a vertical multiple choke unit 20 through which the drilling fluid is delivered downwardly at an appropriate pressure to the cavity 16.

The disc control valve 15 is controlled by an axial shaft 21 which is connected by a coupling 22 to the output shaft of the roll stabilized control unit 9.

The roll stabilized control unit maintains the shaft 21 substantially stationary at a rotational orientation which is selected, either from the surface or by a downhole computer program, according to the direction in which the drill bit is to be steered. As the bias unit rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally in a selected direction. The selected rotational position of the shaft 21 in space thus determines the direction in which the bias unit is actually displaced and hence the direction in which the drill bit is steered.

Figure 3:
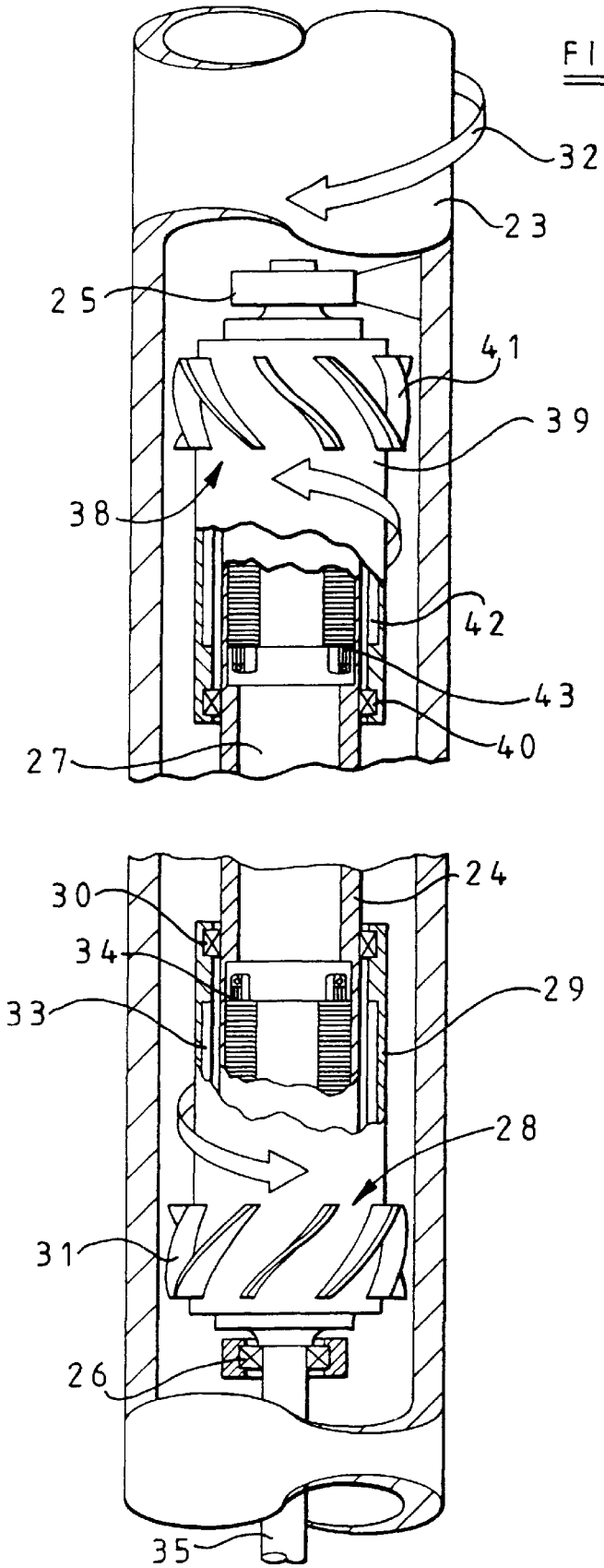
FIG. 3 is a diagrammatic longitudinal section through a roll stabilized instrumentation package, acting as a control unit for the bias unit of FIGS. 1 and 2.

FIG. 3 shows diagrammatically, in greater detail, one form of roll stabilized control unit for controlling a bias unit of the kind shown in FIG. 2. Other forms of roll stabilized control unit are described in British Patent Specification No. 2257182, and in co-pending Application No. 9503828.7

Referring to FIG. 3, the support for the control unit comprises a tubular drill collar 23 forming part of the drill string. The control unit comprises an elongate generally cylindrical hollow instrument carrier 24 mounted in bearings 25, 26 supported within the drill collar 23, for rotation relative to the drill collar 23 about the central longitudinal axis thereof. The carrier has one or more internal compartments which contain an instrument package 27 comprising sensors for sensing the rotation and orientation of the control unit, and associated equipment for processing signals from the sensors and controlling the rotation of the carrier.

At the lower end of the control unit a multi-bladed impeller 28 is rotatably mounted on the carrier 24. The impeller comprises a cylindrical sleeve 29 which encircles the carrier and is mounted in bearings 30 thereon. The blades 31 of the impeller are rigidly mounted on the lower end of the sleeve 29. During drilling operations the drill string, including the drill collar 23, will normally rotate clockwise, as indicated by the arrow 32, and the impeller 28 is so designed that it tends to be rotated anti-clockwise as a result of the flow of drilling fluid down the interior of the collar 23 and across the impeller blades 31.

The impeller 28 is coupled to the instrument carrier 24, by an electrical torquer-generator. The sleeve 29 contains around its inner periphery a pole structure comprising an array of permanent magnets 33 cooperating with an armature 34 fixed within the carrier 24. The magnet/armature arrangement serves as a variable drive coupling between the impeller 28 and the carrier 24.

A second impeller 38 is mounted adjacent the upper end of the carrier 24. The second impeller is, like the first impeller 28, also coupled to the carrier 24 in such a manner that the torque it imparts to the carrier can be varied. The upper impeller 38 is generally similar in construction to the lower impeller 28 and comprises a cylindrical sleeve 39 which encircles the carrier casing and is mounted in bearings 40 thereon. The blades 41 of the impeller are rigidly mounted on the upper end of the sleeve 39.

However, the blades of the upper impeller are so designed that the impeller tends to be rotated clockwise as a result of the flow of drilling fluid down the interior of the collar 23 and across the impeller blades 41.

Like the impeller 28, the impeller 38 is coupled the carrier 24 by an electrical torquer-generator. The sleeve 39 contains around its inner periphery an array of permanent magnets 42 cooperating with an armature 43 fixed within the carrier 24. The magnet/armature arrangement serves as a variable drive coupling between the impeller 38 and the carrier.

As the drill collar 23 rotates during drilling, the main bearings 25, 26 and the disc valve 15 of the bias unit apply a clockwise input torque to the carrier 24 and a further clockwise torque is applied by the upper impeller 38 through the torquer-generator 42,43 and its bearings 40. These clockwise torques are opposed by an anti-clockwise torque applied to the carrier by the lower impeller 28. The torque applied to the carrier 24 by each impeller may be varied by varying the electrical load on each generator constituted by the magnets 33 or 42 and the armature 34 or 43. This variable load is applied by generator load control units under the control of a micro-processor in the instrument package 27. During steered drilling there are fed to the processor an input signal indicative of the required rotational orientation (roll angle) of the carrier 24, and feedback signals from roll sensors included in the instrument package 27. The input signal may be transmitted to the control unit from the surface, or may be derived from a downhole program defining the desired path of the borehole being drilled in comparison with survey data derived downhole.

The processor is pre-programmed to process the feedback signal which is indicative of the rotational orientation of the carrier 24 in space, and the input signal which is indicative of the desired rotational orientation of the carrier, and to feed a resultant output signal to generator load control units. During steered drilling, the output signal is such as to cause the generator load control units to apply to the torquer-generators 33, 34 and 42,43 electrical loads of such magnitude that the net anticlockwise torque applied to the carrier 24 by the two torquer-generators opposes and balances the other clockwise torques applied to the carrier, such as the bearing torque, so as to maintain the carrier non-rotating in space, and at the rotational orientation demanded by the input signal.

The output from the control unit 9 is provided by the rotational orientation of the carrier itself and the carrier is thus mechanically connected by a single control shaft 35 to the input shaft 21 of the bias unit 10 shown in FIG. 2.

During normal steering operation of the control unit and bias unit, the clockwise torque applied by the second, upper impeller 38 may be maintained constant so that control of the rotational speed of the control unit relative to the drill collar, and its rotational position in space, are determined solely by control of the main, lower impeller 28, the constant clockwise torque of the upper impeller being selected so that the main impeller operates substantially in the useful, linear part of its range.

However, since the clockwise torque may also be varied by varying the electrical load on the upper torquer-generator 42, 43 control means in the instrument package may control the two torquer-generators in such manner as to cause any required net torque, within a permitted range, to be applied to the carrier by the impellers. This net torque will be the difference between the clockwise torque applied by the upper impeller 38, bearings etc. and the anticlockwise torque applied by the lower impeller 28. The control of net torque provided by the two impellers may therefore be employed to roll stabilize the control unit during steering operation, but it may also be employed to cause the control unit to perform rotations or part-rotations in space, or relative to the drill collar 23, either clockwise or anti-clockwise or in a sequence of both, and at any speed within a permitted range. For rotation relative to the drill collar the torquers are controlled by a sensor providing signals dependent on the angle between the instrument carrier 24 and the drill collar 23, and/or its rate of change. This ability to control rotation of the control unit is utilized in certain aspects of the present invention, as will be described below.

Figure 4:
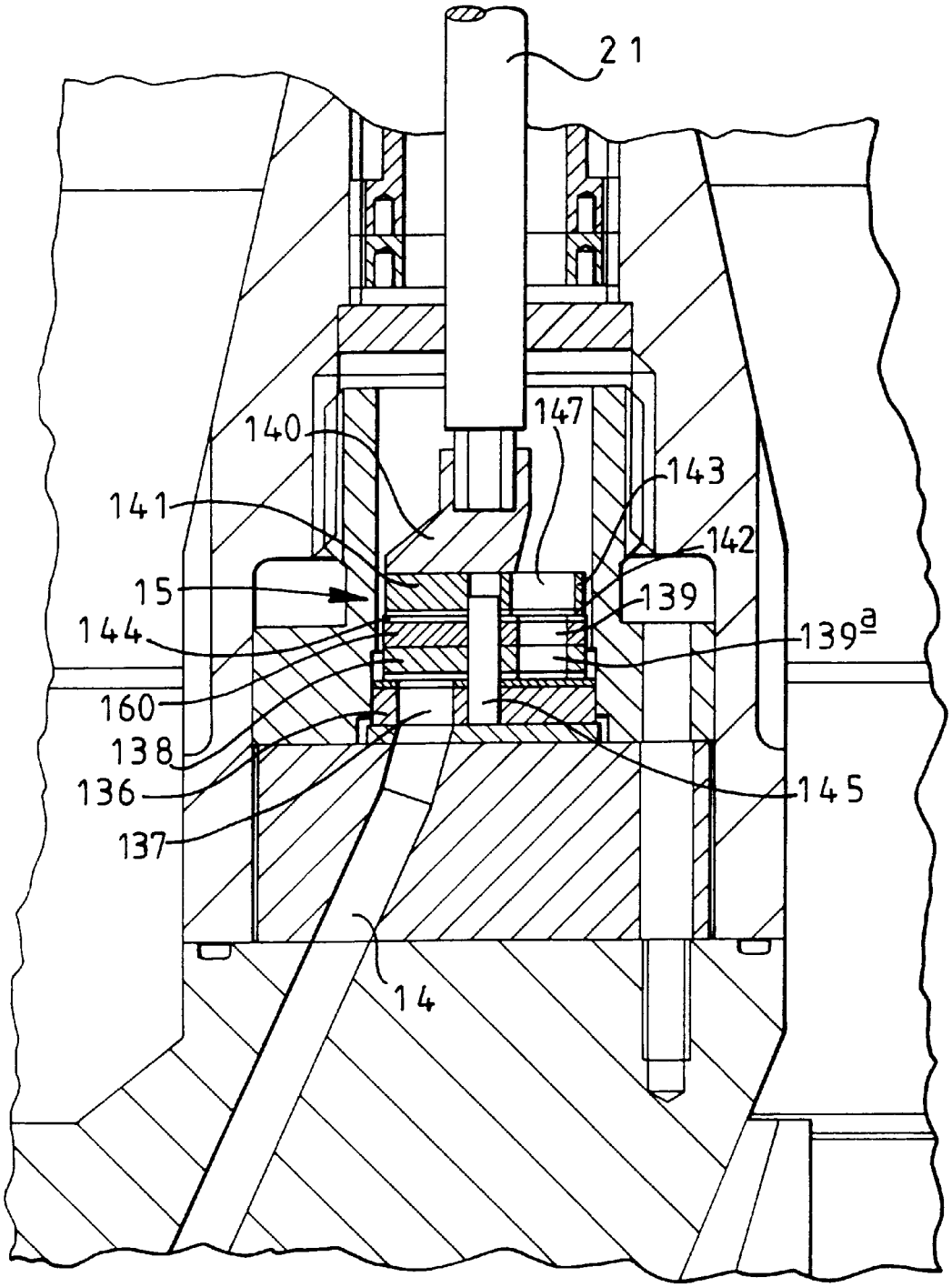
FIG. 4 is a longitudinal section, on an enlarged scale, of a modified form of control valve and shut-off valve in a bias unit for use in a preferred embodiment of the invention.
Figure 5:
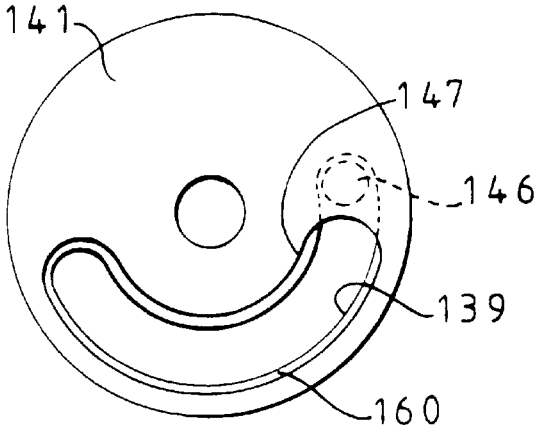
FIGS. 5 and 6 are diagrammatic plan views of two of the elements of the shut-off valve of FIG. 4, showing first and second positions thereof respectively.
Figure 6:
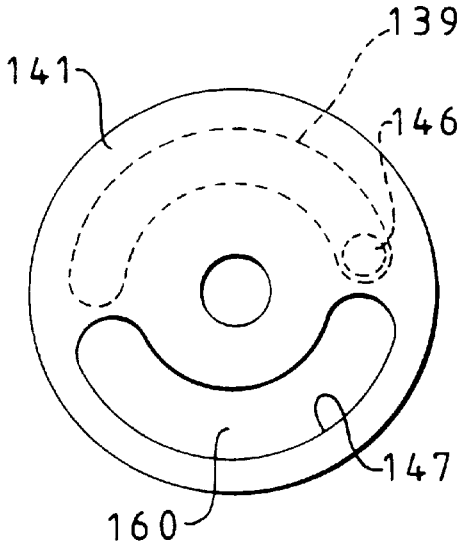

In order to permit turning off or reduction of the biasing effect of the bias unit during drilling, an auxiliary shut-off valve is provided in series with the control valve 15, as is shown in greater detail in FIGS. 4 to 6.

Referring to FIG. 4, the lower disc 136 of the disc control valve 15 is brazed or glued on a fixed part of the body structure of the bias unit and is formed with three equally circumferentially spaced circular apertures 137 each of which registers with a respective passage 14 in the body structure.

The upper disc 138 of the control valve is brazed to the tungsten carbide face of a similar third disc 160 which is connected by a lost motion connection to a fourth, further disc 141 which is brazed or glued to the element 140 on the shaft 21. The discs 141 and 160 constitute the auxiliary shut-off valve. The fourth disc 141 comprises a lower facing layer 142 of polycrystalline diamond bonded to a thicker substrate 143 of tungsten carbide. The third disc 160 is provided with an upper facing layer 144 of polycrystalline diamond, which bears against the layer 142, on the further disc 141. The disc 138 has a lower facing layer of polycrystalline diamond which bears against a similar upper facing layer on the lower disc 136. The four discs 136, 138, 141 and 160 are located on an axial pin 145, which may be of polycrystalline diamond, and is received in registering central sockets in the discs.

The lost motion connection between the disc 160 and the fourth, further disc 141 comprises a downwardly projecting circular pin 146 (see FIG. 5) which projects from the lower surface of the disc 141 into registering arcuate slots 139, 139*a* in the valve discs 160 and 138. As best seen in FIG. 5 the upper disc 141 is formed with an arcuate slot 147 which is of similar width and radius to the slot 139 but of smaller angular extent.

During steered drilling operations the drill bit and bias unit 10 rotate clockwise, and the control shaft 21 is maintained substantially stationary in space at a rotational orientation determined by the required direction of bias, as previously described. Consequently the bias unit and lower disc 136 of the control valve rotate clockwise relative to the shaft 21, the disc 138 of the control valve, and the upper discs 160 and 141. The frictional engagement between the lower disc 136 and disc 138 of the control valve rotates the discs 138 and 160 clockwise relative to the stationary upper disc 141 so that the right hand end of the slot 139 (as seen in FIG. 5) engages the pin 146 on the disc 141. In this position the arcuate slot 147 in the uppermost disc 141 registers with the major part of the arcuate slot 160 in the disc 138 so that drilling fluid under pressure passes through the registering slots and then through the spaced apertures 137 in the lower disc 136 in succession as the disc 136 is rotated beneath the disc 138.

This is the position of the valve components during drilling when a lateral bias is required. If it is required to shut off the bias, the control unit 9 is instructed, either by pre-programming of its downhole processor or by a signal from the surface, to reverse its direction of rotation relative to the drill string, i.e. to rotate clockwise in space at a rotational speed faster than the rate of clockwise rotation of the drill bit and bias unit for at least half a revolution. This causes the shaft 21 and hence the disc 141 to rotate clockwise relative to the bias unit and to the lowermost disc 136. This reversal may be continuous or of short duration.

Under these conditions, the frictional torque of the disc 138 on the lowermost disc 136 exceeds that between the fourth disc 141 and the third disc 160. The fourth disc 141 rotates clockwise relative to the third disc 160 until the lost motion between the two discs is taken up so that the pin 146 is moved to the opposite end of the slot 139, as shown in FIG. 8. This brings the slot 139 out of register with the slot 147 in the uppermost disc 141, so that the slots 139 and 139*a*, and hence the apertures 137, are cut off from communication with the drilling fluid under pressure. As a consequence the hydraulic actuators of the bias unit are no longer operated in succession and the force exerted on the formation by the movable thrust members of the actuators falls to zero or is substantially reduced.

In order to provide the required frictional torque differential between the discs to achieve the above manner of operation, the discs 136 and 138 may be larger in radius than the discs 160 and 141. Alternatively or additionally, the slot 147 is preferably wider than the slot 139 to provide a greater downward axial hydraulic force on the disc 160, and thus give greater total force between the discs 138 and 136 than between the discs 141 and 160 when the auxiliary valve is open. Also, part of the upper surface of the disc 160 may be rebated from one edge to increase the axial hydraulic force on the disc 160 when the auxiliary valve is closed.

Although the primary purpose of the auxiliary shut-off valve is to enable operation of the hydraulic actuators to be interrupted, in order to neutralize or reduce the biasing effect, each time the shut-off valve is opened there is diverted to the hydraulic actuators, and hence to the annulus, a proportion of the drilling fluid which was previously passing through the drill bit. The effect of this is to generate a significant pressure drop in the drilling fluid each time the valve is opened. The system therefore acts as a negative pulser. According to the present invention, therefore, data to be transmitted to the surface or to another downhole location, may be encoded as one or a sequence of successive reversals in the direction of rotation of the instrument carrier, resulting in the generation of a corresponding sequence of pressure pulses in the drilling fluid, which may be detected and decoded at the surface or downhole location.

For example, the control unit 9 will normally include MWD sensors which generate data signals indicative of operating parameters of the bottom hole assembly, such as azimuth and inclination, and other devices in the control unit may generate signals indicative of the command status of the control unit, whether such status is derived from a signal transmitted downhole to the control unit from the surface or from a pre-programmed micro-processor in the control unit.

The instrumentation in the control unit may therefore include means for receiving the aforesaid data signals, for example from the MWD sensors, and controlling the impellers 28, 38 in a manner to cause the instrument carrier 24 to execute a reversal of its direction of rotation relative to the drill collar 23, or a sequential pattern of successive reversals, which is dependent on the content of said data signals and which therefore encodes the data signals as rotations of the instrument carrier, and consequently as a pattern of successive operations of the shut-off valve 141, 160, to generate a corresponding pattern of pressure pulses in the drilling fluid.

According to the invention detection apparatus is located at the surface, or at another location downhole, to detect the pulses in the drilling fluid which are due to the operation of the shut-off valve. The pressure pulse detection apparatus includes means for interpreting and decoding the pressure pulses to derive from them the information contained in the original downhole data signals.

The general nature of such detection apparatus will be known to those skilled in the art since, as previously mentioned, it is common practice to use pulses in the drilling fluid as a means of transmitting data to the surface. Such detection means will not therefore be described in detail. The detection apparatus requires to include filtering means to distinguish the pressure fluctuations due to the shut-off valve from the noise of pressure fluctuations in the drilling fluid due to other causes, for example, due to mud pumps at the surface. The pressure fluctuations due to the bias unit may, for example, be of the order of 10–20 psi whereas the pressure fluctuations in transmission of data by a conventional MWD pulser may be of the order of 100 psi. The pulse detection apparatus therefore requires to take this into account. However, in operation of the steerable rotary drilling system of the kind described above, the upward data transfer rate can be comparatively low when compared to the data rates required with other MWD systems or steerable drilling systems. For example, a data rate of, say, one quarter bit/second, or even one tenth bit/second, may be sufficient and such a low data rate will allow a relatively low signal/noise ratio. The low data rate may also avoid mutual interference with other pressure pulse MWD systems which may be in use at the same time. Alternatively or additionally such interference may be avoided by suitable filtering and/or a suitable transmission protocol, but at the expense of data rate.

Although it will normally be required for the data to be transmitted to the surface, it may in some circumstances merely be necessary to transmit the data as pressure pulses through the drilling fluid as a short range link to another device downhole. For example, the downhole device may be a booster signal generator having an independent power supply which transmits the data onwards to the surface either again by pressure pulses through the drilling fluid or by some other telemetry arrangement. Alternatively it may be an operative component which requires the data signals as an input parameter.

During normal operation of the bias unit, the rotation of the valve 15 itself will also generate pressure pulses in the drilling fluid, irrespective of any operation of the associated shut-off valve. According to another aspect of the present invention, therefore, data may be encoded as a pattern of rotations of the control unit which causes a consequent pattern of pressure pulses generated in the drilling fluid by the control valve 15 itself.

Rotations of the control unit from its normal roll-stabilized orientation will modify the operation of the control valve 15. These changes in operation of the valve 15 in turn modify the pulse sequences being transmitted to the surface, through the drilling fluid, by the valve. The characteristics of the changed pulse sequences therefore amount to an encoded form of the data transmitted to the control unit in the aforementioned data signals.

For normal operation of the bias unit, the control valve 15 would normally be so designed that, as it rotates and opens ports to the three hydraulic actuators in succession, it does not generate significant fundamental or third harmonic frequency oscillations in the drilling fluid. This is to avoid possible confusion with conventional pressure pulse MWD systems which may be in use. For example, the ports leading to the hydraulic actuators will usually be so arranged that they are symmetrical about the axis of rotation of the control valve and so that the total area of the ports which is open at any instant remains substantially constant as the control valve rotates.

According to the present invention, however, in the case where the operation of the control valve 15 itself is used to generate pressure pulse signals for detection at the surface, or at another location downhole, the arrangement of the ports in the control valve is non-symmetrical about the axis of rotation so as to introduce fundamental frequency oscillations in the drilling fluid. Also, third harmonic frequency oscillations are introduced by arranging for the total area of the ports which is open to vary significantly as the valve rotates.

Although the present invention provides means for transmitting to the surface specific data derived downhole, for example from downhole sensors, it may also allow monitoring of the operation of the bias unit by simply detecting and interpreting pressure pulses which are transmitted through the drilling fluid merely as a result of the normal operation of the bias unit.

Thus, when the bias unit is operating, whether in a steering mode or neutral mode, the pulses which the bias unit transmits through the drilling fluid as a result of such operation can simply be detected and interpreted to indicate that the bias unit is operating correctly. For example, when first being introduced into an existing borehole, the bias unit may be temporarily held just below the surface and various tests of its operation carried out, in which case the characteristic pulses resulting from such tests will indicated whether or not everything is in order. Also, any required changes in the operation of the bias unit under the control of the control unit, whether such changes are initiated by a downward signal from the surface or from a pre-programmed processor in the control unit, will result in a change in the characteristics of the pulses transmitted upwardly by the bias unit, and these pulses will therefore serve as an indication that the required change in operation of the bias unit has been effected.

Whereas the present invention has been described in particular relation to the drawings attached hereto, it should be understood that other and further modifications, apart from those shown or suggested herein, may be made within the scope and spirit of the present invention.

What is claimed:

1. A method of operating a steerable rotary drilling system having a bottom hole assembly which includes a drill bit, a modulated bias unit and a control unit, the bias unit comprising a number of hydraulic actuators at the periphery of the unit for engagement with the formation of the borehole being drilled, each hydraulic actuator including a movable thrust member which is hydraulically displaceable, and each movable thrust member having an inlet passage for connection to a source of pressurised fluid, the pressure of fluid supplied to the movable thrust members from said source being controlled by valve means and the operation of the valve means being controlled by the control unit so as to modulate the fluid pressure supplied to the actuators as the bias unit rotates, the method including the step of deriving data signals from sensors in the bottom hole assembly, causing the control unit to control the bias unit in a manner dependent on said data signals from the sensors, detecting pulses transmitted through the fluid as a result of the consequent operation of the bias unit, and interpreting said pulses to derive therefrom data corresponding to said data signals from said sensors.

2. A method according to claim 1, wherein said valve means includes at least one shut-off valve in series with said movable thrust members, the method including causing the control unit to operate said shut-off valve, in a manner dependent on said data signals from the sensors, to transmit said pulses through the fluid.

3. A method according to claim 2, including encoding the data signals as a sequential pattern of successive operations of said shut-off valve.

4. A method according to claim 2, wherein the bottom hole assembly is mounted on a rotatable drill string and the control unit comprises an instrument carrier which can be roll stabilised so as to remain substantially non-rotating in space relative to the drill string when the drill string is rotating, the direction of bias of the bias unit being determined by the rotational orientation of the instrument carrier in space, the method including operating said shut-off valve by reversal of the direction of relative rotation between the instrument carrier and the drill string, and encoding said data signals as a sequential pattern of successive reversals of said relative rotation.

5. A method according to claim 4, wherein the instrument carrier includes a sensor to determine the angular position of the instrument carrier relative to said drill string, and/or the rate of change of said angular position of the instrument carrier relative to the drill string, the method including using output from said sensor as an input parameter in the control of the rotation of the instrument carrier.

6. A method according to claim 4, including effecting rotational control of the instrument carrier by the provision of two contra-rotating controllable torque impellers on the instrument carrier.

7. A method according to claim 1, wherein the bottom hole assembly is mounted on a rotatable drill string and the control unit comprises an instrument carrier which can be roll stabilised so as to remain substantially non-rotating in space relative to the drill string when the drill string is rotating, the direction of bias of the bias unit being determined by the rotational orientation of the instrument carrier in space, the method including encoding the data signals as a rotation, or sequential pattern of rotations, of the instrument carrier relative to the drill string.

8. A method according to claim 1, wherein the sensors in the bottom hole assembly are of a kind to provide data signals concerning at least one of: the azimuth of part of the bottom hole assembly, the inclination of part of the bottom hole assembly, and the roll angle of the control unit.

9. A method according to claim 1, wherein the sensors are geological sensors responsive to characteristics of an earth formation through which the bottom hole assembly is passing.

10. A method according to claim 1, including holding the drill bit off the bottom of the borehole while detecting said pulses.

11. A method according to claim 1, including reducing the biasing effect of the bias unit while detecting said pulses.

12. A method of operating a steerable rotary drilling system having a bottom hole assembly which includes a drill bit, a modulated bias unit and a control unit, the bias unit comprising a number of hydraulic actuators at the periphery of the unit for engagement with the formation of the borehole being drilled, each hydraulic actuator including a movable thrust member which is hydraulically displaceable, and each movable thrust member having an inlet passage for connection to a source of pressurised fluid, the pressure of fluid supplied to the movable thrust members from said source being controlled by valve means and the operation of the valve means being controlled by the control unit so as to modulate the fluid pressure supplied to the actuators as the bias unit rotates, the method comprising the steps of detecting pulses transmitted through the fluid as a result of operation of the bias unit, and interpreting said pulses to obtain information regarding the operation of the bottom hole assembly including the bias unit.

13. A method according to claim 12, including generating pulses by the operation of the valve means controlling the hydraulic actuators, and detecting and interpreting said pulses.

14. A method according to claim 12, including detecting and interpreting said pulses at a location on the earth's surface, and using the information derived therefrom as an input parameter for control of the bottom hole assembly.

15. A method according to claim 12, including detecting and interpreting said pulses at a downhole location, and using the information derived therefrom as an input parameter for a further data transmission device to transmit data corresponding to said pulses to a location on the earth's surface.

16. A method according to claim 12, including the step, when the bias unit is first being introduced into an existing borehole, of temporarily holding the bias unit just below the surface and carrying out various tests of its operation, the characteristic pulses resulting from such test indicating whether or not everything is in order.

* * * * *